United States Patent [19]

Netravali et al.

[11] 4,454,506

[45] Jun. 12, 1984

[54] METHOD AND CIRCUITRY FOR REDUCING FLICKER IN SYMBOL DISPLAYS

[75] Inventors: Arun N. Netravali, Westfield, N.J.; Peter Pirsch, Hanover, Fed. Rep. of Germany

[73] Assignee: Bell Telephone Laboratories, Incorporated, Murray Hill, N.J.

[21] Appl. No.: 299,531

[22] Filed: Sep. 4, 1981

[51] Int. Cl.[3] ..... G09G 1/16

[52] U.S. Cl. ..... 340/728; 340/791

[58] Field of Search ..... 340/728, 791, 793

[56] References Cited

U.S. PATENT DOCUMENTS

| | | | |
|---|---|---|---|
| 2,921,124 | 1/1960 | Graham | 340/728 |
| 3,192,315 | 6/1965 | Remley | 358/133 |
| 3,573,789 | 4/1971 | Sharp et al. | 340/728 |
| 3,953,668 | 4/1976 | Judice | 358/133 |
| 4,063,232 | 12/1977 | Fernald | 340/728 |
| 4,215,414 | 7/1980 | Huelsman | 340/728 |
| 4,237,457 | 12/1980 | Houldsworth | 340/793 |
| 4,354,186 | 10/1982 | Groothuis | 340/728 |

*Primary Examiner*—Marshall M. Curtis

*Attorney, Agent, or Firm*—John A. Caccuro

[57] ABSTRACT

The flicker which results from large intensity differences in adjacent scan lines of a symbol displayed in an interlaced-field format is reduced by a non-linear signal filter and signal generator. The disclosed filter and signal generator changes the intensity of a scan line adjacent to a scan line of a symbol in response to a detected predetermined intensity difference between the adjacent scan line and the symbol scan line.

15 Claims, 5 Drawing Figures

| X1 | X0 | LEVEL |
|---|---|---|
| 0 | 0 | V0 |
| 0 | 1 | V1 |
| 1 | 0 | V2 |
| 1 | 1 | V3 |

METHOD AND CIRCUITRY FOR REDUCING FLICKER IN SYMBOL DISPLAYS

FIELD OF THE INVENTION

The present invention relates to video signal processing and display and more particularly to the display of symbols in an interlaced-field format.

BACKGROUND OF THE INVENTION

In most videotex systems, text is received over the telephone line and displayed on a raster scan display (typically a television receiver). Character fonts used for raster scan display devices are usually represented by a matrix of binary bits and displayed as a matrix of black and white dots. The black/white dot matrix representing the video characters is typically derived from the corresponding character representation used in hard copy devices.

A problem arises, however, when the black/white dot matrix is used for video characters. The problem arises because conventional cathode ray tube (CRT) systems use an interlaced-field display format. In such an interlaced-field format, when a white character is displayed on a black background, or vice-versa, an annoying flicker results in the displayed symbol. Flicker results when two adjacent scan lines at the black/white vertical transition (horizontal edge) of the character, each in a different field of the display, are at a much different brightness level. Thus, for example, flicker results in a television receiver when a white scan line is followed approximately 1/60 of a second (field time) later by a black scan line. The combination of the large contrast and the time delay creates the annoying flicker. Flicker is undesirable since it causes the viewer to experience eye fatigue after prolonged viewing of the display.

It is known in the art to reduce the flicker caused in interlace-field displays by using a superposition technique or by using a scan line repeating technique. Superposition of the field removes the flicker, but results in a loss of vertical resolution. Repeating the data in the adjacent lines also reduces the visibility of line structures.

Low pass filtering can also be utilized to reduce flicker. For example, U.S. Pat. No. 3,953,668, issued on Apr. 27, 1967 to C. N. Judice, entitled "Method and Arrangement for Eliminating Flicker in Interlaced Ordered Dither Images" describes an area weighting method which averages the intensity of a group of cells on adjacent scan lines.

Additionally, U.S. Pat. No. 3,192,315, issued on June 29, 1965, to W. R. Remley and entitled "Two Dimensional Bandwidth Reduction Apparatus for Raster Scanning Systems" describes apparatus for smoothing the contrast of a raster symbol in both the direction of the scan and in the direction perpendicular to the direction of the scan. Both of the above patents, however, result in a sacrifice in sharpness of the entire picture to accomplish a reduction in flicker. Additionally, the Remley patent produces lines of non-uniform intensity which distorts the size and shape of the characters resulting in a reduction in the legibility of the characters.

Grey level character fonts have also been used to reduce flicker in CRT displays. For example, in *Proceedings of the Conference SIGGRAPH'80*, an article entitled "The Display of Characters Using Grey Level Sample Arrays", by J. E. Warnock, dated July, 1980, pp. 302–307 and *SID Digest*, an article entitled "Soft Fonts", by N. Negroponte, dated 1980, pp. 184–185. However, these type of arrangements require the storage, at the receiver, of grey level signals representing each received black/white character. Considerable memory is required to store the multi-level grey character signals.

Thus, there is a continuing need in the art to reduce the flicker in characters displayed on a interlace-field display devices (CRT) without sacrificing the sharpness of the entire picture being displayed or the need for large character memories.

SUMMARY OF THE INVENTION

The present invention generates grey level symbol representation from existing black/white symbol data. The result is that every sharp vertical intensity transition (horizontal edge) of a displayed symbol is made less sharp to reduce the flicker. This reduces the flicker when sharply contrasting symbols (characters, graphical primitives or mosaic patterns) are displayed on an interlaced-field display device without a sacrifice in the sharpness of the remaining picture being displayed.

The present invention detects when the amplitude of the video signal (which controls the brightness on a CRT) of a section (one or more pels) of a scan line of a symbol to be displayed differs by a predetermined amount from the video signal amplitude of a corresponding section of an scan line adjacent to the symbol. Once detected, a non-linear filter and signal generator circuit changes the signal level of the section of the adjacent scan line to reduce the difference amplitude between it and the corresponding section of the scan line of the symbol. The result is that the brightness of sections of scan lines which either proceed or follow large vertical brightness transitions (black/white horizontal edges) of the symbol is changed to an intermediate grey level to reduce the brightness transition. Since only the signal amplitude of adjacent scan lines, which either preceed or follow each black/white horizontal edge of the symbol, are changed, the original symbol is not distorted. The result is a reduction of the flicker of the displayed symbol even though the symbol appears somewhat more blurred. When the symbols displayed are characters the apparent resolution increases, allowing the use of smaller character fonts. The present invention is likewise applicable to color signals. In such an application flicker is reduced by using a predetermined transition color at the horizontal edge of a symbol of one color displayed on a background of a second color.

BRIEF DESCRIPTION OF THE DRAWING

The principles of the invention will be more fully appreciated from the illustrative embodiment shown in the drawing, in which.

DETAILED DESCRIPTION

Figure 1:
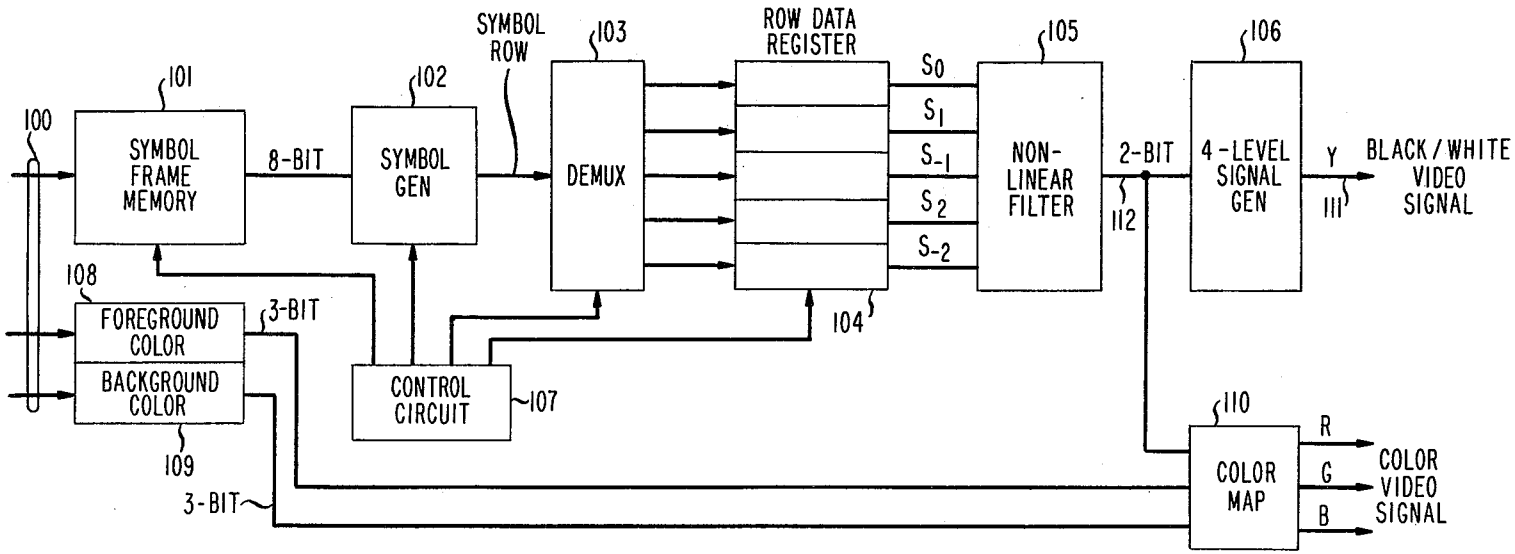
FIG. 1 shows an embodiment of an interlaced-field symbol display system incorporating the disclosed non-linear filter and four-level signal generator.

FIG. 1 shows a block diagram of an interlaced-field symbol display system. When the display system utilizes only two colors (black/white) the foreground color unit 108, background color unit 109 and color map unit 110 of FIG. 1 are not utilized. When the display system is a color system the color map 110 replaces the four-level generator 106. The invention will first be described for use in a binary color (black/white) symbol display system.

Figure 5:
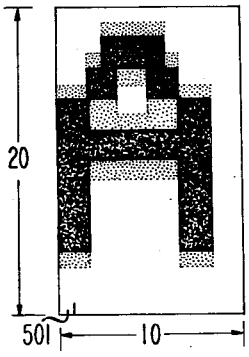
FIG. 5 shows the effect of the non-linear filter on a black/white character.

In many videotex systems, especially those utilizing a low bandwidth communication channel, symbol information (including characters, graphical primitives and mosaic pattern information) is transmitted as a binary code rather than as the actual matrix of data bits for generating the character. In the symbol display system shown in FIG. 1, the binary coded symbol information is received over channel 100 and stored in frame memory 101. Thus, received information on the symbols to be displayed during a frame (consisting of two interlaced-fields) is available during the entire frame. Symbol generator 102, which connects to symbol frame memory 101, is actually a look-up table implemented using a read only memory (ROM), although a random access memory (RAM) or other type of memory could be utilized. Symbol generator 102 decodes or converts the 8-bit binary coded character information into a matrix of data bits, organized in a row-column format, which described the character. This character data matrix when displayed would have, for example, the twenty row by ten column matrix as shown in FIG. 5.

Returning to FIG. 1, demultiplexer 103 selects, under control of control circuit 107, rows of the symbol data matrix for storage in a parallel to serial register 104. The parallel to serial register 104 stores five rows of data bits. As will be described in a later paragraph, the generation of the display scan signal representing a particular row of the symbol data matrix, requires data from both the two rows preceeding and the two rows following the particular row. The symbol row data that is stored in register 104, indicated as $S_{-2}$, $S_{-1}$, $S_0$, $S_1$ and $S_2$, in FIG. 1 depends on what particular row of the symbol is being generated. Thus, if $S_0$ represents pel of row 3 (in the odd field) of the symbol data matrix, then rows 1, 2, 3, 4 and 5 are selected by demultiplexer 103, in a well known manner, from symbol generator 102. Thus, demultiplexer 103 selects in combination with the control circuit 107 the appropriate five rows of symbol data bits from symbol generator 102, to enable non-linear vertical filter 105 to generate a two bit binary code which describes the black/white video signal information for each data bit of the particular row of the symbol being displayed.

Control circuit 107 synchronizes the operation of frame memory 101, symbol generator 102, demultiplexer 103, register 104 and the CRT display unit (not shown).

Figure 2:
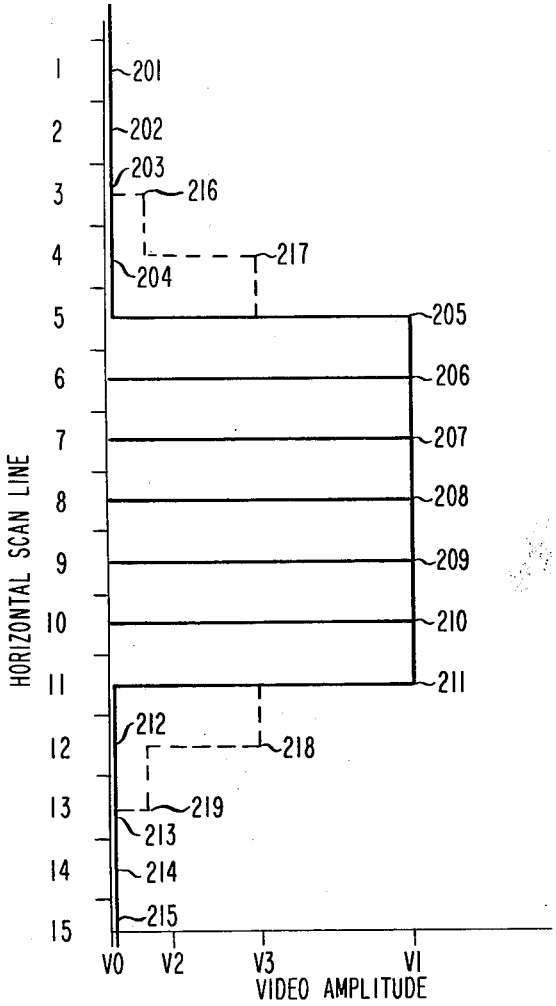
FIG. 2 shows the amplitude of the resulting grey level signal on scan lines which are adjacent the black/-white horizontal edges of the character.

In a black/white character display system of FIG. 1, non-linear filter 105 receives the signals from register 104 and generates a two bit binary code which four-level generator 106 converts into a black/white video signal 111 (Y) having four discrete video amplitude levels V0, V1, V2 and V3. The two intermediate grey level signals V2 and V3 only occur at each black/white horizontal edge of a character. With reference to FIG. 2, these intermediate grey level signals are described. FIG. 2 shows, as an ordinate, the same horizontal position (matrix data bit or picture element) of consecutive scan lines (1–15) of a typical interlaced-field display. The result is a vertical line of picture elements (pels) representing one column of a displayed character. Scan lines 1, 3, 5, 7, 9, 11, 13 and 15 represent the "odd" field while scan lines 2, 4, 6, 8, 10, 12 and 14 represent the alternate or "even" field. The scan lines shown in FIG. 2 are merely illustrative of a raster scan display format. The abscissa of FIG. 2 depicts the video signal amplitude of each pel in the vertical line of pels. Thus, the column of pels depicted in FIG. 2 would be similar to column 501 of the character "A" depicted in FIG. 5.

Returning to FIG. 2, the video signal of one column of a stored (unfiltered) character, from symbol generator 102, is depicted. The intensity of the corresponding pels (sections) of scan lines 1, 2, 3 and 4 is, respectively, 201, 202, 203 and 204 in FIG. 2, all of which are at a signal level of V0. The signal level of pels of scan lines 5 through 11 is V1, as illustrated by 205 through 211. Finally, the signal level of the pels of scan lines 12 through 15 is V0, as illustrated by 212 through 215. Thus, the column of pels in scan lines 1 through 15 represent, illustratively, a white/black/white vertical line. The above unfiltered binary black/white column signal from symbol generator 102 is filtered by non-linear filter 105 of FIG. 1 and becomes the filtered (four-level, grey scale) column signal (111 of FIG. 1) shown in FIG. 2.

According to the present invention, only the amplitude of pels (shown in dotted lines on FIG. 2) of scan lines which preceed or follow a predetermined intensity transition are changed. Thus, when the large signal transition from pel 204 of scan line 4 to pel 205 of scan line 5 is detected by non-linear filter 105 of FIG. 1 the amplitude of pel 203 of scan line 3 is set at 216 (V2) and the amplitude of pel 204 of scan line 4 is set at 217 (V3) by four-level signal generator 106. Similarly, non-linear filter 105 of FIG. 1 detects the large signal transition from pel 211 of scan line 11 to pel 212 of scan line 12 and four-level generator 106 establishes amplitudes 218 and 219 for the corresponding pels of scan lines 12 and 13. The resulting filtered column signal is shown in FIG. 2 as having two intermediate signal levels V2 and V3 between the original signal levels V0 and V1 of the unfiltered column signal. The resulting column signal has significantly reduced flicker when displayed on an interlaced-field display device. While non-linear filter 105 and four-level generator of FIG. 1 generates a four-level output (V0, V1, V2 or V3) other multi-level outputs are easily emplemented as will be described in a later paragraph. For example, a three-level output having only one intermediate signal level would also reduce flicker in the displayed character.

It is to be noted that the described invention is not limited to any particular signal amplitude for the intermediate grey levels. Both the number of intermediate level and their amplitude can be selected to both simplify the non-linear filter design and reduce the flicker. The selection of (brightness) values for the intermediate levels to reduce flicker tends to be subjective in nature and is determined on a trial and error basis for a particular application. A typical value for V3 is one-half of (V1-V0). A typical value for V2 is one-eighth of (V1-V0). These values represent a compromise between flicker reduction and character blurriness under a typical viewing condition. This compromise is also a function of the parameters of the display (brightness, contrast, etc.) as well as viewing conditions.

FIG. 5 depicts the output of a character "A" from a non-linear filter and three-level generator having only one intermediate level between V0 and V1 of FIG. 2. Such an implementation will be described in a later paragraph. The black (V1) character "A" represents the unfiltered character inputted to the non-linear filter. The shaded area shows the segments of each scan line which had its signal changed from white (V0) to an intermediate grey level (between V0 and V1). The filtered character "A" out of the non-linear filter thus includes the black and shaded area shown in FIG. 5. It is seen that all black/white horizontal edges have been softened to a more gradual contrast transition with a subsequent reduction in flicker. It is further noted that the original character is not distorted as it would be if a linear filter is utilized.

Figure 3:
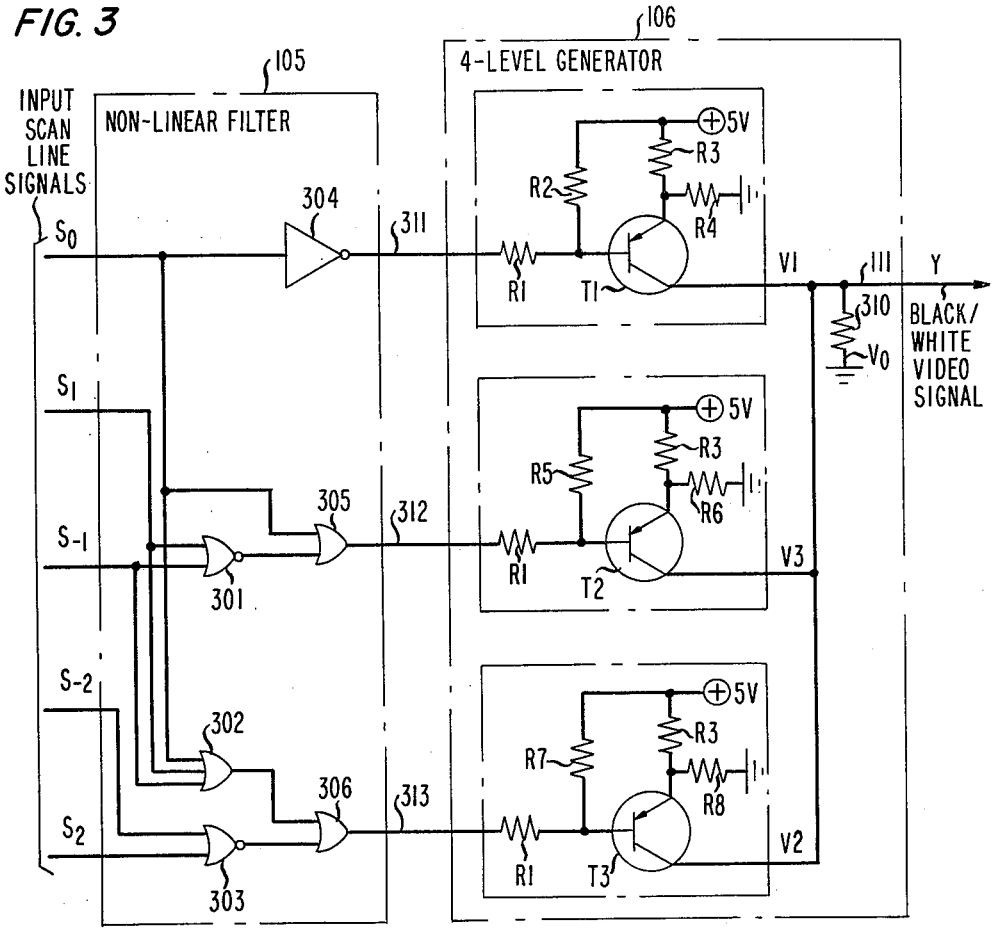
FIG. 3 shows a circuit embodiment of a non-linear filter and four-level signal generator used to generate filtered (four-level grey scale) character signals from unfiltered (binary-black/white) character signals.

When non-linear filter 105 and four-level generator 106 of FIG. 1 are utilized, a second additional grey level signal (having an intensity level between the white and grey illustrated in FIG. 3) appears at the grey/white horizontal edges of character "A". In an actual display the grey level would be so close to white that it would not consciously be detected by the viewer. However, the viewer would notice an additional reduction in the flicker of character "A".

Returning to FIG. 2, it is noted that if non-linear filter 105 and four-level signal generator 106 of FIG. 1 has to change the amplitude of element 203 of scan line 3 in response to a predetermined signal transition which occurs during a later scan line 5, the signals from scan line 5 must be available during scan line 3. With reference to FIG. 1 and as previously noted, register 104 provides non-linear filter 105 with inputs from five scan lines ($S_{-2}$, $S_{-1}$ $S_0$, $S_1$, $S_2$). $S_0$ represents a pel of the current scan line of the character or symbol. The subscript zero is used for the present scan line (i.e. $S_0$) which the non-linear filter and four-level signal generator may change the video signal of. $S_{-1}$ is a pel of the preceeding adjacent scan line while $S_{-2}$ is a pel of the second preceeding (non-adjacent) scan line. Similarly, $S_1$ is a pel of the next adjacent scan line while $S_2$ is a pel of the second next (non-adjacent) scan line. The generation of these various character scan line signals is described in the following paragraphs.

A combined embodiment of non-linear filter 105 and four-level generator 106 is shown in FIG. 3. In the particular embodiment shown in FIG. 3, the outputs from non-linear filter 105 are the decoded outputs 311, 312 and 313 rather than the two bit binary coded output 112 shown in FIG. 1. In the particular embodiment of FIG. 3 a decoder, which is shown as part of the four-level signal generator 106 of FIG. 1, is incorporated as part of non-linear filter 105. Such an embodiment is merely illustrative of many embodiments which could be utilized to provide the functions of non-linear filter 105 and four-level signal generator 106.

The output of non-linear filter 105 and four-level signal generator 106 of FIG. 3 can be described by the following set of equations:

$$Y = \begin{cases} V1, \text{ if } S_0 = V1, \\ V3, \text{ if } [S_0 = V0] \text{ and } [(S_1 = V1) \text{ or } (S_{-1} = V1)] \\ V2, \text{ if } [S_{-1} = S_0 = S_1 = V0] \text{ and } [(S_2 = V1) \text{ or } (S_{-2} = V1)] \\ V0, \text{ if } S_{-2} = S_{-1} = S_0 = S_1 = S_2 = V0 \end{cases}$$

where $S_i$(i=0, −1, −2, 1, 2) are pels at the same position (lie in the same column) on consecutive scan lines of a frame. As previously noted, $S_0$ represents the unfiltered input pel of the present scan line while Y represents the filtered output pel.

The operation of non-linear filter 105 of FIG. 3 is described with joint reference to FIG. 1 and to the scan line signals of FIG. 2. Assume that the pel $S_0$ of the present scan line at the display is currently at scan line 2 in FIG. 2. Thus, the respective scan lines for $S_{-2}$ is 15, $S_{-1}$ is 1, $S_1$ is 3 and $S_2$ is 4. Assume also that signal level V0 is the black level and is represented by a logic 0 signal level (low signal) while signal level V1 is the white signal level at a logic 1 signal level (high signal).

Since scan line 2 of FIG. 2 represents the present scan line, all the inputs $S_{-2}$, $S_{-1}$, $S_0$, $S_1$ and $S_2$ are at signal level V0 (logic 0). Note, the signal signal levels V0 and V1 are scaled to be consistent with the logic levels of the circuits utilized in the implementation of non-linear filter 105 of FIG. 3. As previously noted the various pel information $S_{-2}$, $S_{-1}$, $S_0$, $S_1$, $S_2$, in binary form, is made available from symbol generator 102 utilizing demultiplexer 103 and register 104. Note, since only binary information (black/white) is required for each bit of the symbol matrix, symbol generator 102 does not require as large a memory as when grey levels are stored in a symbol generator.

Register 104 simultaneously outputs the signal levels of the pels $S_{-2}$, $S_{-1}$, $S_0$, $S_1$ and $S_2$ to non-linear filter 105. Thus, register 104 synchronizes the information fed to the combinatorial logic circuits 301 through 306. The outputs from register 104 are simultaneous outputted under control of common control 104 which operates in synchronism with the display device (not shown) in order to generate, in a timely manner, the video output signal Y. The logic circuits 301 through 306 compare the signals and detect when the signals of each scan line has changed a predetermined amount.

Since the present pel $S_0$ was assumed to be at line 2 of FIG. 2, the input signals $S_{-2}$, $S_{-1}$, $S_0$, $S_1$ and $S_2$ are at logic 0 (V0). Input signals $S_{-2}$ and $S_2$ are received at the inputs of NOR gate 303 and cause a logic 1 output therefrom. Input signals $S_0$, $S_{-1}$ and $S_1$ are received at OR gate 302 and cause a logic 0 output therefrom. The output of NOR gate 303 and OR gate 302 connect to the inputs of OR gate 306. Since the output of NOR gate 303 is at logic 1 the output of OR gate 306 is logic 1. The output 313 of OR gate 306 drives output circuit 309, of four-level generator 106, consisting of transistor T3 and resistors R1, R7, R3 and R8. The output of circuit 309, (collector of transistor T3) connects to the outputs of circuits 307 and 308 and resistor 310. Resistor 310 provides a common load impedance to the "collector ored" output circuits 307, 308 and 309. It is across the resistor 310 that the filtered video signal Y is outputted to the display device. Thus, output circuits 307, 308 and 309 and resistor 310 provide means for generating the filtered video signal Y, at 111 (Y) of FIG. 3, in the response to the received signals $S_{-2}$, $S_{-1}$, $S_0$, $S_1$ and $S_2$.

Since the output 313 of OR gate 306 is at logic 1 (high signals) resistors R1 and R7 bias the base of transistor T3 at a level higher than the emitter bias formed by resistors R3 and R8. Hence transistor T3 is in the non-conduction state, open collector state, and draws no current through resistor 310. The value of the base and emitter bias resistors R1, R7, R3 and R8 are selected such that when transistor T3 is turned on sufficient current flows through resistor 310 to establish the voltage level of V2 across resistor 310.

The inputs $S_{-1}$ and $S_1$ are also received at the inputs to NOR gate 301 and cause a logic 1 output therefrom. The output of NOR gate 301 connects to an input of OR gate 305. The input $S_0$ is also received at the input of inverter gate 304 and at an input of OR gate 305. The output of OR gate 305 is at logic 1 since the output of NOR gate 301 is at logic 1. The output of OR gate 305 connects to output circuit 308. The output circuit 308 is identical to output circuit 309 except for the value of bias resistors R5 and R6. The base and emitter bias resistors R5 and R6 are selected such that if transistor T2 is turned "on", sufficient current flows through resistor 310 to establish the voltage level of V3 across resistor 310. Since the output of OR gate 305 is at logic 1, resistors R1 and R5 keep transistor T2 biased "off" and hence no current flows to resistor 310.

The output of inverter 304 is at logic 1 since the input $S_0$ is at logic 0. The output of inverter 304 connects to output circuit 307 which is identical to output circuit 308 except for the value of bias resistors R2 and R4. Since the output of inverter 304 is at logic 1, the base to emitter junction of transistor T1 is reverse biased and transistor T1 does not conduct. Again, when transistor T1 is turned "on", sufficient current flows from the +5 volt supply through emitter bias resistor R3, transistor T1 to resistor 310 to establish the voltage level V1 across resistor 310 to ground. Since none of the output circuits 307, 308 or 309 are turned "on", output signal Y across resistor 310 is low (zero volts), the voltage level for V0. Thus, as depicted by FIG. 2, when the present pel $S_0$ is at scan line 2 of the symbol the inputs $S_{-2}$, $S_{-1}$, $S_0$, $S_1$ and $S_2$ are at V0 and the filtered output Y (described by the equations above) is also at signal level V0 (203 of FIG. 2).

When the present pel $S_0$ is at scan line 3 in FIG. 2, only input $S_2$ has changed level from V0 to V1. Hence, output circuits 307 and 308 remain "off" while output circuit 309 is turned "on". The input $S_2$ is logic 1 causing a logic 0 output from NOR gate 303. Since the output of OR gate 302 is still at logic 0 (since $S_0$, $S_{-1}$, $S_1$ are still at V0) the output of OR gate becomes logic 0 (since both of its inputs are at logic 0). The logic 0 output of OR gate 306 biases the base emitter junction of transistor T3 "on" and causes a current flow from the +5 V supply through resistor R3 transistor T3 to resistor 310. Since output circuits 307 and 308 are "off" a voltage level V2 is established as the filtered output Y. Again, the level V2 for Y is as described by the above identified equations for the non-linear filter 105 of FIG. 1. This signal level V2 is shown by 216 of FIG. 2. Note, as shown by FIG. 2, the same level V2 results for Y when the present scan line is scan line 13 of the display. In that case $S_{-2}$ is at level V1 and all other signals $S_{-1}$, $S_0$, $S_1$, $S_2$ are at level V0. Hence, again output circuits 307 and 308 are "off" and output circuit 309 is "on" since the output of NOR gate 108 becomes logic 0 due to the logic 1 signal of $S_{-2}$.

When the present pel $S_0$ is advanced from scan line 3 to scan line 4 of the FIG. 2 display only input $S_1$ is changed. The inputs $S_{-2}$, $S_{-1}$, $S_0$ remain at level V0 while $S_2$ remains at level V1. Thus, output circuit 307, a function only of input $S_0$, remains "off" and output circuit 309 goes in "off" state because the output of OR gate 302 becomes logic 1 and consequently output 313 becomes logic 1. Output circuit 308 turns "on" since input $S_1$ causes the output of NOR gate 301 to become logic 0 which causes the output of OR gate 305 to become logic 0, thus turning "on" transistor T2 of output circuit 308. When transistor T2 turns "on" resistors R3 and R6 cause sufficient current to flow through resistor 310 to establish the voltage level V3 for output signal Y. This signal level is depicted by 217 of FIG. 2 and is described by the above equation for Y. Again, as shown in FIG. 2, a similar result occurs when the present pel $S_0$ is at scan line 12 of the display.

When the present scan line is advanced from scan line 4 to scan line 5 of the display, only input $S_0$ is changed from V0 to V1. The inputs $S_{-2}$ and $S_{-1}$ remain at level V0 while $S_1$ and $S_2$ remain at level V1. Thus, also output circuits 308 goes in "off" state while output circuit 307 is turned "on". Output circuit 307 turns "on" since input $S_0$ is at logic 1 (V1) causing the output of inverter 304 to be logic 0, thus turning "on" transistor T1 of output circuit 307. When transistor T1 is turned "on" resistors R3 and R4 cause sufficient current to flow through resistor 310 to establish the level V1 for output signal Y. This signal level is depicted by 205 of FIG. 2 and is described by the above equation for Y.

As previously noted, the non-linear filter can be implemented with only one intermediate intensity level. In such an implementation the inputs $S_{-2}$ and $S_2$ are not required. The resulting equations for Y becomes $$Y = \begin{cases} V1, \text{ if } S_0 = V1 \\ V3, \text{ if } [S_0 = V0] \text{ and } [(S_1 = V1) \text{ or } (S_{-1} = V1)] \\ V0, \text{ if } S_{-1} = S_0 = S_1 = V0 \end{cases}$$

Consequently, OR gate 302, NOR gate 303, OR gate 306 and output circuit 309 are not required in such an implementation. The operation of the resulting circuit is similar to that described on the previous paragraphs.

Figure 4:
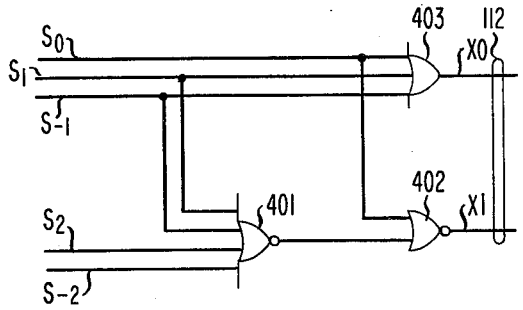
FIG. 4 shows a general circuit embodiment of a non-linear filter.

An alternate embodiment for non-linear filter 105 of FIG. 3 is shown in FIG. 4. In that embodiment, NOR gates 401 and 402 and OR gate 403 logically implement the function as described by the above equation for Y. When $S_{-1}$, $S_0$, $S_1$ and $S_2$ are at V0, the binary encoded outputs X0 and X1 are both 0 indicating a V0 level for Y. When $S_{-1}$, $S_0$ and $S_1$ are at V0 and $S_2$ or $S_{-2}$ are at V1, the outputs X0 and X1 are both 1 indicating a V3 level for Y. When $S_0$ is V0 and $S_1$ or $S_{-1}$ are at V1 then the output X0 is 0 and X1 is 1 indicating a V2 level. Finally, when $S_0$ is V1 then X0 is 1 and X1 is 0, indicating a V1 level for Y. As shown in FIG. 1, the binary outputs X0 and X1 are converted by four-level signal generator 106 into the four levels V0, V1, V2 and V3. The particular embodiment of four-level signal generator 106 is not illustrated herein but could be implemented using a well known two bit binary decoder. Each of the four outputs of such a decoder would drive an output circuit similar to those described in FIG. 3.

It is to be noted that the circuits of FIGS. 3 and 4 are merely representative of a wide variety of known circuits which could implement the equations characterizing the filtered video output signal Y. Additionally, while the invention was described using a black and white signal, the teachings of this invention can be applied to any binary signal representations of a video signal. For example, if the video signal is a color signal, the invention can be applied to a binary signal representation of the foreground (character) color and background color signal.

With reference to FIG. 1, in a multi-colored display system, information describing the character color (foreground color 108) and the color of the background 109 is received over communication channel 100. The output of foreground color unit 108 and background color unit 109, typically 3 bits each, together with the output of non-linear filter 105, two bits, are used to select the proper display color from color map 110. Thus, for example, if the foreground color is red and the background color is green then all the symbols would be red on a background of green. At the horizontal edges where the red symbol interfaces the green background non-linear filter 105 outputs a signal indicating that a color intermediate red and green be used to reduce flicker and enhance resolution. As noted previously, one or two intermediate levels can be utilized. Again, the selection of these intermediate color signals are subjectively determined. Once the intermediate transition colors are selected they are placed in color map 110 which is a look-up table type of ROM or RAM. Thus, when non-linear filter 105 indicates the use of an intermediate color, that intermediate color is selected from color map 110 using the foreground color and background color information also provided to color map 110.

While the above described implementation assumed a local character generator to provide the various required scan line signals it will be obvious to one skilled in the art that the invention can be implemented by using delay circuits or serial shift registers to provide access to the required scan lines. Additionally, when using serial shift registers to generate the required scan lines the disclosed non-linear filter could be utilized to smooth the black/white vertical transition (horizontal edge) on any image being displayed. In such an arrangement, the received video signal would be scaled so that the predetermined video signal difference, required to operate the non-linear filter, is consistent with the operating voltage levels of the non-linear filter.

What has been described is merely illustrative of our invention. Those skilled in the art may advantageously utilize the concepts taught herein to implement other embodiments providing similar functions without deviating from the scope or spirit of the disclosed invention.

What is claimed is:

1. A distortionless method of reducing flicker which occurs at the horizontal boundaries of a symbol displayed in a line scanned interlaced-field display caused by differences between a video signal of a scan line defining the horizontal boundary of the symbol and a video signal of an adjacent non-symbol scan line characterized by the steps of:

detecting when a difference between a first video signal of a section of said adjacent scan line differs from a second video signal of a corresponding section of said symbol scan line by a predetermined non zero amount which indicates a horizontal boundary of said symbol and generating in response to the detecting step a third video signal intermediate said first and second video signal for said section of said adjacent scan line to reduce the video signal difference between said section of said adjacent scan line and said corresponding section of said symbol scan line.

2. The method of claim 1 wherein said detecting step includes the step of:

encoding a bindary output signal specifying one of at least three video signals for said section of said adjacent scan line and said generating step includes the step of decoding said binary output signal into said one of at least three video signals.

3. The method of claim 1 further including the steps of:

further detecting when said first video signal of a section of a non-adjacent scan line two lines from said symbol scan line differs by said predetermined amount from said second video signal of said corresponding section of said symbol scan line and further generating in response to said further detecting step a fourth video signal for said section of said non-adjacent scan line to reduce the video signal difference between said section of said nonadjacent scan line and said section of said adjacent scan line.

4. A circuit for reducing flicker which occurs at the horizontal boundaries of a symbol displayed in a line scanned interlaced-field symbol display caused by differences between a video signal of a scan line defining the horizontal boundary of a symbol and a video signal of an adjacent non-symbol scan line characterized in that said circuit includes means for detecting when a difference between a first video signal of a section of said adjacent scan line differs from a second video signal of a corresponding section of said symbol scan line by a predetermined non zero amount which indicates a horizontal boundary of said symbol and means responsive to said detecting means for generating a third video signal intermediate to said first video signal and said second video signal for said section of said adjacent scan line.

5. The invention of claim 4 wherein said detecting means includes means for encoding a binary output signal specifying one of at least three video signals for said section of said adjacent scan line and said generating means includes means for decoding said binary output signal into said one of at least three video signals.

6. The invention of claim 4 further including second means for detecting when said first video signal of a section of a non-adjacent scan line two lines from said symbol scan line differs by said predetermined amount from said second video signal of said corresponding section of said symbol scan line and second means for generating in response to said second detecting means a fourth video signal intermediate to said first video signal and said third video signal for said section of said non-adjacent scan line.

7. In a line by line raster scanned interlaced-field display circuit for displaying symbols of one color on a background of a second color, a method of generating a background of a third color on non-symbol scan lines adjacent to scan lines defining the horizontal boundary of the symbol characterized by the steps of:

detecting when the color of a section of said adjacent scan line differs from the color of a corresponding section of said scan line of the symbol and generating in response to said detecting step a third color for said section of said adjacent scan line.

8. In a line by line raster scanned interlaced-field display for displaying symbols of one color on a background of a second color, a circuit for generating a background of a third color on non-symbol scan lines adjacent to scan lines defining the horizontal boundary of the symbol characterized in that said circuit includes means for detecting when the color of a section of said adjacent scan line differs from the color of a corresponding section of said scan line of the symbol and means responsive to said detecting means for generating a third color for said section of said adjacent scan line.

9. The invention of claim 8 wherein said detecting means includes means for storing coded symbol signals received at said display system, memory means responsive to said coded symbol storing means for converting a received coded symbol signal into color scan line signals, and means for comparing said color scan line signals of said adjacent scan line with that of said scan line of the symbol.

10. A raster scanned interlaced-field display system characterized in that said system comprises means for storing binary color scan line signals representing symbols of one color on a background of a second color, means for accessing said binary color scan line signals and circuit means for generating a third background color signal from said binary color scan line signals, said circuit means including means for detecting when the background color of a section of an adjacent non-symbol scan line signal differs from the color of a corresponding section of a scan line defining the horizontal boundary of the symbol and means responsive to said detecting means for generating said third background color for said section of said adjacent scan line.

11. The invention of claim 10 wherein said color scan line signal storing means includes means for storing coded symbol signals received at said display system and preprogrammed memory means responsive to said coded symbol storing means for converting a received coded symbol signal into said binary color scan line signals.

12. The invention of claim 10 wherein said generating means includes means for receiving symbol color information, means for receiving background color information, and color memory means responsive to said symbol color receiving means, background color receiving means and said detecting means for selecting said third background color for said section of said adjacent scan line.

13. A method of generating raster scanned interlaced-field display signals for symbols having a video signal level V1 on a background having a video signal level V0, characterized by the steps of:

first receiving a present scan line signal $S_0$ at a video signal level V0 or V1, second receiving a previous scan line signal $S_{-1}$ at a video signal level V0 or V1, third receiving a subsequent scan line signal $S_1$ at a video signal level V0 or V1, and generating in response to said first, second and third receiving steps a present scan line display signal Y from the relationship:

$$Y = \begin{cases} V1, \text{ if } S_0 = V1 \\ V3, \text{ if } [S_0 = V0] \text{ and } [(S_1 = V1) \text{ or } (S_{-1} = V1)] \\ V0, \text{ if } S_{-1} = S_0 = S_1 = V0 \end{cases}$$

14. A circuit for generating raster scanned interlaced-field display signals for symbols having a video signal level V1 on a background having a video signal level V0, characterized in that said circuit includes first means for receiving a present scan line signal $S_0$ at a video signal level V0 or V1, second means for receiving a previous scan line signal $S_{-1}$ at a video signal level V0 or V1, third means for receiving a subsequent scan line signal $S_1$ at a video signal level V0 or V1, and means responsive to said first, second and third receiving means for generating a present scan line display signal Y from the relationship:

$$Y = \begin{cases} V1, \text{ if } S_0 = V1 \\ V3, \text{ if } [S_0 = V0] \text{ and } [(S_1 = V1) \text{ or } (S_{-1} = V1)] \\ V0, \text{ if } S_{-1} = S_0 = S_1 = V0 \end{cases}$$

15. A circuit for generating raster scanned interlaced-field display signals for symbols having a video signal level V1 on a background having a video signal level V0, characterized in that said circuit includes first means for receiving a present scan line signal $S_0$ at a video signal level V0 or V1, second means for receiving a previous scan line signal $S_{-1}$ at a video signal level V0 or V1, third means for receiving a subsequent scan line signal $S_1$ at a video signal level V0 or V1, fourth means for receiving a second previous scan line signal $S_{-2}$ at a video signal level V0 or V1, fifth means for receiving a second subsequent scan line signal $S_2$ at a video signal level V0 or V1, and means responsive to said first, second, third, fourth and fifth receiving means for generating a present scan line display signal Y from the relationship:

$$Y = \begin{cases} V1, \text{ if } S_0 = V1, \\ V3, \text{ if } S_0 = V0 \text{ and } [(S_1 = V1) \text{ or } (S_{-1} = V1)] \\ V2, \text{ if } [S_{-1} = S_0 = S_1 = V0] \text{ and } [S_2 = V1 \text{ or } (S_{-2} = V1)] \\ V0, \text{ if } S_{-2} = S_{-1} = S_0 = S_1 = S_2 = V0 \end{cases}$$

* * * * *